US005167375A

United States Patent [19]

Datta

[11] Patent Number: 5,167,375

[45] Date of Patent: Dec. 1, 1992

[54] APPARATUS FOR MINERAL MATTER SEPARATION

[76] Inventor: Rabinder S. Datta, 610 Tampico Ct., Pittsburgh, Pa. 15239

[21] Appl. No.: 519,889

[22] Filed: May 7, 1990

Related U.S. Application Data

[60] Division of Ser. No. 392,701, Aug. 11, 1989, Pat. No. 4,964,576, which is a continuation of Ser. No. 176,947, Apr. 4, 1988, abandoned.

[51] Int. Cl.[5] ..... B02C 23/30

[52] U.S. Cl. ..... 241/46.02; 241/46.17; 241/79.1; 241/38

[58] Field of Search ..... 241/18, 19, 21, 24, 241/27, 46.02, 46.11, 46.17, 79.1, 171, 172, 46 R, 46.08, 46.13, 46.06, 38; 209/164, 169, 170; 210/173

[56] References Cited

U.S. PATENT DOCUMENTS

| | | | |
|---|---|---|---|
| 3,102,855 | 9/1963 | Brown et al. | 209/164 |
| 3,135,474 | 6/1964 | Schoid | 241/21 |
| 3,149,789 | 9/1964 | Szegvari | 241/27 |
| 3,202,281 | 8/1965 | Weston | 209/166 |
| 3,226,044 | 12/1965 | Matsubayashi et al. | 241/172 |
| 3,255,881 | 6/1966 | Holderreed et al. | 209/1 |
| 3,298,519 | 1/1967 | Hollingsworth | 209/165 |
| 3,450,356 | 6/1969 | Szegvari | 241/172 |
| 3,486,705 | 12/1969 | Szegvari | 241/172 |
| 3,606,176 | 9/1971 | Vodic | 241/20 |
| 3,652,011 | 3/1972 | Engels | 241/171 |
| 3,672,580 | 6/1972 | Nye | 241/79 |
| 3,682,399 | 8/1972 | Kaspar et al. | 241/50 |
| 3,746,265 | 7/1973 | Dancy | 241/72 |
| 3,802,633 | 4/1974 | Schold | 241/72 |
| 3,844,490 | 10/1974 | Schold et al. | 241/74 |
| 4,156,593 | 5/1979 | Tarpley | 241/20 |
| 4,287,054 | 9/1981 | Hollingsworth | 209/170 |
| 4,326,855 | 4/1982 | Cottell | 44/51 |
| 4,366,050 | 12/1982 | Olin et al. | 209/167 |
| 4,404,022 | 9/1983 | Godbehere | 75/2 |
| 4,450,072 | 5/1984 | Suplicki | 209/170 |
| 4,564,369 | 1/1986 | Burgess et al. | 44/2 |
| 4,593,859 | 6/1986 | Nakaoji et al. | 241/20 |
| 4,597,857 | 7/1986 | Norrgran et al. | 209/166 |
| 4,597,858 | 7/1986 | Burgess et al. | 209/166 |
| 4,639,313 | 1/1987 | Zipperian | 209/170 |
| 4,750,994 | 6/1988 | Schneider | 209/170 |
| 4,754,934 | 7/1988 | Ikebuchi et al. | 241/69 |

FOREIGN PATENT DOCUMENTS 594294 2/1978 U.S.S.R.

OTHER PUBLICATIONS

*Surface Chemistry of Froth*, Jan Leja, pp. 14–20.

*SME Mining Engineering Handbook*, 1973, vol. 2, pp. 27–56 through 27–59.

*Primary Examiner*—Joseph M. Gorski

[57] ABSTRACT

A combination of raw coal and water is introduced as a slurry into a vessel. Chemicals are introduced at a feed inlet. The mixture is reduced by interaction with a bed of agitated grinding balls. Air is introduced into the lower portion of the vessel and forced upwardly through the circuitous passages among and between the grinding balls. The rising air bubbles carry the more hydrophobic product upwardly into a froth compartment of the vessel and through a discharge outlet of the vessel. Wash water is introduced into the upper portion of the vessel and descends through the froth and the ball passages carrying entrained and less hydrophobic particles into the grinding chamber. The non-floatable material flows downwardly from the grinding chamber to a refuse zone for discharge as refuse from the vessel.

14 Claims, 4 Drawing Sheets

APPARATUS FOR MINERAL MATTER SEPARATION

This application is a division of application Ser. No. 392,701, filed Aug. 11, 1989, issued as U.S. Pat. No. 4,964,576 on Oct. 23, 1990, which in turn was a continuation of Ser. No. 176,947, filed Apr. 4, 1988, since abandoned.

BACKGROUND OF THE INVENTION

1. Field of the Invention

The present invention relates to method and apparatus for accomplishing size reduction, classification, and separation of carbonaceous and noncarbonaceous mineral matter, and more particularly to method and apparatus for reducing the size of the mineral matter and separating the valuable constituent from the gangue.

2. Description of the Prior Art

Over the past years substantial research has been conducted on the subject of utilizing domestic coal to provide a reliable, low-cost source of clean fuel. As a result of the research it has been found that the major drawback to the use of coal as a fuel is the mineral matter impurities present in it. It is recognized that the development of a low-cost, highly beneficiated clean coal will provide an attractive alternative for the energy market.

Known beneficiation processes generally concentrate or improve the physical and chemical properties of the raw material by removing a large fraction of the impurities present in the mineral. Minerals and ores, e.g., oil shale, copper ore and iron ore have also been beneficiated in order to produce feedstock for recovering the shale oil or extracting the copper and iron. However, there is a need to enhance the efficiency of the size reduction and separation devices so as to produce the minerals and clean fuels at a cost and in a form that is economically attractive.

In conventional ball mills, the material to be ground is introduced into the mill at one end and the ground fine product is removed at the other end. The grinding media in the mill is alternatively stirred, vibrated, or tumbled to provide the energy necessary to grind/fracture the material to finer sizes.

A ball mill grinding apparatus as disclosed in U.S. Pat. No. 594,294 includes a ported mixer paddle whereby water is supplied to the mixing chamber. The movement of the metal balls through the injected slurry serves to reduce the size of the material particles. Other similar patents, namely Soviet Patents 3,149,789; 3,450,356; 3,226,044; and 3,486,705 disclose method and apparatus using liquid and grinding balls in combination with stirring paddles to process the injected solid matter.

In a conventional agglomeration beneficiation scheme, the material, such as coal, is comminuted to a predetermined average size such that the majority of the particles are liberated for separation. The coal in a water slurry is then introduced into a series of tanks and subjected to high and low shear agitation in the presence of the agglomerant. The agglomerated coal is separated from the refuse in the aqueous phase. The clean coal agglomerates may be subjected to a second separation step to separate the mineral matter which tend to get entrapped in the agglomerates.

A known separator is a froth flotation cell where the hydrophobic particles e.g. clean coal, are separated from the hydrophilic particles, e.g. pyrite and other ash forming minerals. However, if the separation is not efficient the refuse may contain a high organic content or the clean coal may contain a higher than required mineral matter (ash) content. Consequently, in order to correct the problem one or more of the following operations must be additionally performed: (1) reduce the average particle size of the feed, (2) comminute and reprocess the middling, or (3) change the density of separation. Variations in the feed coal quality, as a result of changes in the in-seam coal quality, may result in higher than normal losses in organic recoveries if product quality is maintained.

A conventional gravity separation circuit uses heavy liquids, organic or inorganic, for achieving the separation of the coal and associated mineral matter. In the circuit, coal is reduced to a predetermined size and separated in a cyclone, using heavy liquids of a known density. If the middlings contain a high organic content which would result in low coal recoveries, then they are reduced to a finer size and subjected to two or more heavy liquid separation stages to obtain a final product which meets grade and recovery specifications.

In a froth flotation cell, air is diffused into the slurry in the form of fine bubbles. Sufficient mixing is provided so as to enhance the probability of the hydrophobic particles striking and attaching themselves to an air bubble. A relatively quiescent zone is provided so that the froth is formed and removed. In general the two main objectives are: (1) to achieve a high recovery of the hydrophobic species into the froth product and (2) to retain the maximum amount of the hydrophilic species in the slurry. For the beneficiation of fine and ultrafine particulates a device is provided for the generation of extremely fine or microbubbles, resulting in greater selectivity in the process.

The figure below diagrammatically illustrates a beneficiation circuit, utilizing the froth flotation separation process, consisting of various unit operations for the production of low-ash coal. The cumulative effect of inefficiencies in controlling and operating each of the several unit operations results in designing a larger circuit with reduced recoveries and leads to higher operating and capital costs.

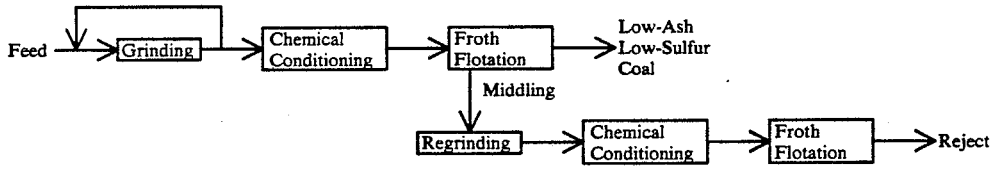

Many efforts have been made to improve the beneficiation of coal and other materials by means of improving the froth flotation process. For example, U.S. Pat. No. 4,326,855 teaches a beneficiation process whereby "clean slurry" is ground and cavitated by sonic energy removing any contaminants including iron pyrites and ash.

U.S. Pat. No. 3,746,265 teaches a gravity beneficiation process whereby the source comminuted potash ore is subjected to gravity separation and subsequently subjected to froth flotation. U.S. Pat. No. 4,593,859 also discloses a gravity separation beneficiation process.

U.S. Pat. No. 4,564,369 teaches an apparatus whereby coal is pulverized and its surface is treated by contact with chemical reactants for ultimate removal of hydrophillic impurities.

U.S. Pat. Nos. 4,597,858; 4,564,369; 4,597,857; and 4,593,859 disclose processes or methods for improvements of the beneficiation and/or separation of valuable material from its impurities.

Overall the known processes, such as sink and float separation, froth flotation, emerging selective agglomeration, and selective flocculation techniques require that the steps of size reduction of the material and the separation of its constituents be performed in separate chambers. Therefore, there is a need for a process whereby all the operations of size reduction, mineral classification and separation take place simultaneously in a single vessel in order to achieve higher separation efficiencies and reduced energy, chemical and space requirements. By making the beneficiation process more efficient and cost effective it will enhance the competitive position of clean and ultra-clean coal in the energy marketplace.

SUMMARY OF THE INVENTION

In accordance with the present invention there is provided a process for combined size reduction, classification, and separation of a desired constituent from an undesired constituent of mineral matter that includes the steps of introducing a slurry of mineral matter into a vessel. The slurry of mineral matter is directed downwardly to a size reduction zone of the vessel. A separation inducing fluid is injected under pressure into the vessel and upwardly into the size reduction zone. The upward flow of the fluid and the downwardly descending flow of mineral matter slurry are admixed in the size reduction zone. The mineral matter of the slurry is ground in the size reduction zone to a predetermined particle size. The particles of a desired constituent in the mineral matter are liberated in the size reduction zone from particles of an undesired constituent in the mineral matter. The liberated particles of the desired constituent are entrained in an upward flow of the fluid from the size reduction zone to a separation zone. The undesired constituent in the mineral matter is carried downwardly in the vessel away from the separation zone to a refuse zone. The entrained desired constituent is discharged from the upper portion of the vessel. The undesired constituent in the refuse zone is removed from the vessel.

Further in accordance with the present invention there is provided a process for combined size reduction, classification and separation of minerals and other material that includes the steps of feeding a slurry of mineral matter for beneficiation into a vessel. The slurry of mineral matter is directed downwardly to a size reduction zone of the vessel. Gas under pressure is injected into the vessel and upwardly into the size reduction zone. The upward flow of pressurized gas and downwardly descending flow of mineral slurry are admixed in the size reduction zone. The particle size of the mineral matter is reduced in the size reduction zone. Hydrophobic particles and hydrophilic particles are liberated from the mineral matter. Gas bubbles are generated as the pressurized gas passes through the size reduction zone. The hydrophobic and hydrophilic particles are admixed with the gas bubbles in the size reduction zone. The hydrophobic particles are attached to the gas bubbles to form a rising column of froth in the vessel. The hydrophobic particles entrained in the froth are discharged out of the upper portion of the vessel. The hydrophilic particles are retained in the slurry and settle in a refuse zone of the vessel. Thereafter the hydrophilic particles are removed from the refuse zone of the vessel.

Additionally the present invention is directed to apparatus for producing a beneficiated mineral product that includes an elongated vessel having an upper end portion with an opening and a lower end portion with an opening. An inlet in the vessel is positioned intermediate the upper and lower end portions for introducing into the vessel a downward flow of a slurry of mineral product. Means is positioned in the vessel for agitating the mineral product to reduce the particle size of the mineral product into a valuable constituent and a refuse constituent. The valuable constituent is less dense than the refuse constituent. The valuable constituent is separated from the refuse constituent by upward flow of the valuable constituent with the fluid and downward flow of the refuse constituent in the vessel. An outlet in the opening of the vessel upper end portion is provided for discharging the upward flow of the valuable constituent of the mineral product from the vessel. An outlet in the opening of the vessel lower end portion is provided for discharging the downward flow of the refuse constituent of the mineral product from the vessel.

Further in accordance with the present invention there is provided a mill for the simultaneous size reduction of particulate mineral product and separation of the valuable mineral constituent from the gangue that includes an elongated vessel having an inlet for receiving a slurry feed of particulate mineral product, an upper outlet for discharging the valuable mineral constituent, and a lower outlet for discharging the gangue. Agitating means positioned in the vessel extends upwardly from adjacent the lower outlet for fracturing the particulate mineral product into a valuable mineral constituent and a gangue. An inlet is provided for introducing fluid under pressure into mixture with the valuable mineral constituent to form a froth. The valuable mineral constituent is entrained in the froth and rises upwardly in the vessel for discharge through the upper outlet. The gangue being entrained in the slurry feed descends downwardly in the vessel for separation from the valuable mineral constituent and removal from the vessel through the lower outlet.

Accordingly, the principal object of the present invention is to provide an improved size reduction and mineral separation method and apparatus for producing a cost competitive carbonaceous material as an energy source.

A further object of the present invention is to provide a process for the beneficiation of carbonaceous and noncarbonaceous minerals, ferrous and nonferrous ores, and other materials that simultaneously performs the operations of size reduction of material and the separation of the refuse or undesirable constituents from the desirable constituents in one chamber or vessel.

An additional object of the present invention is to provide method and apparatus for energy efficient size reduction of mineral matter separation of valuable constituent from the gangue by froth flotation in a single vessel.

Another object of the present invention is to provide a method for accomplishing combined size reduction, classification, and separation of mineral material in a continuous mode that utilizes on-line analyzers to control solids and fluids flow and other operating variables to achieve a cost efficient upgrading of mineral material.

These and other objects of the present invention will be more completely disclosed and described in the following specification, the accompanying drawings and the appended claims.

DESCRIPTION OF THE PREFERRED EMBODIMENTS

Figure 1:
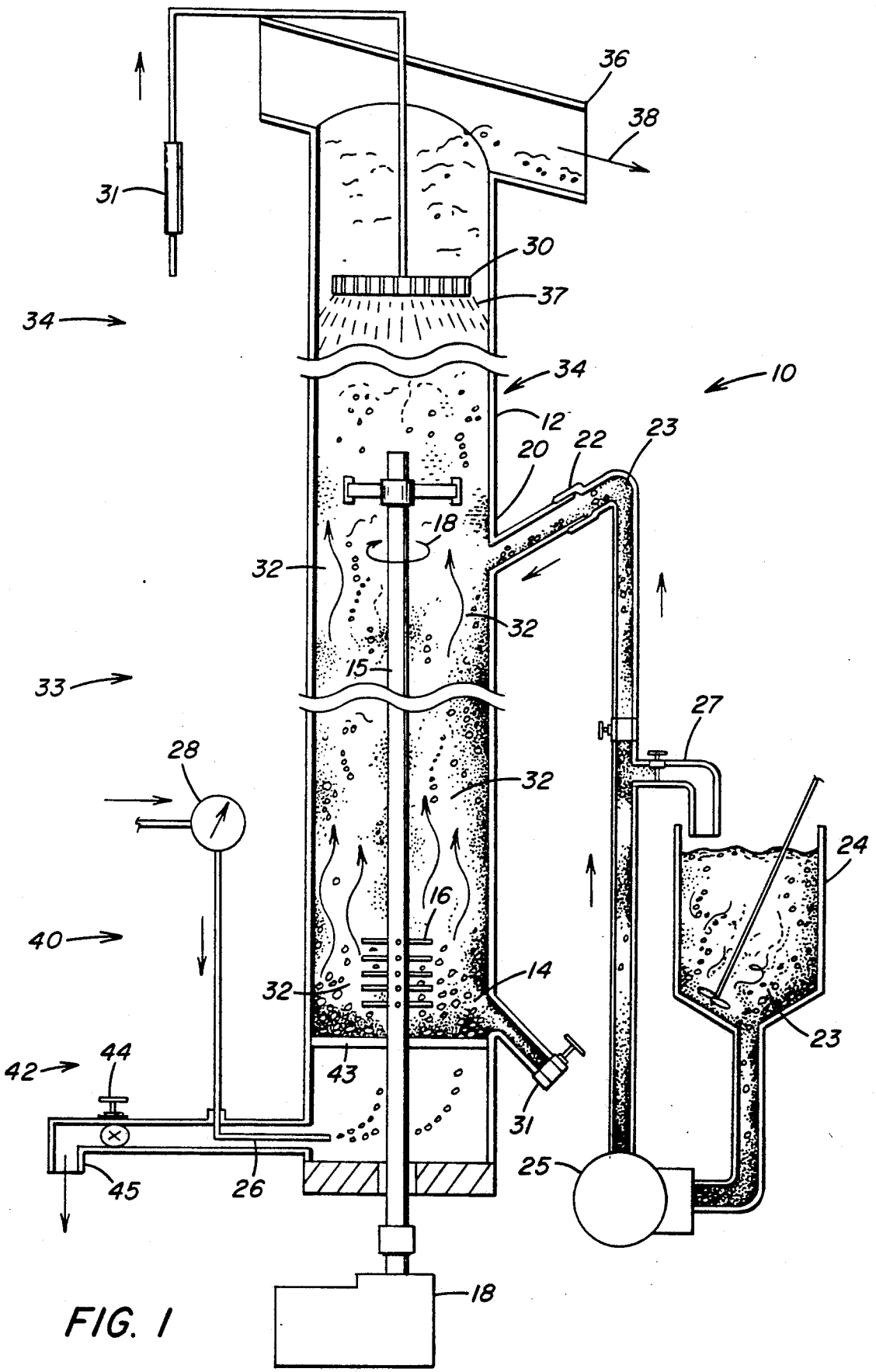
FIG. 1 is a schematic elevational view of a mineral beneficiation vessel in accordance with the present invention.
Figure 2:
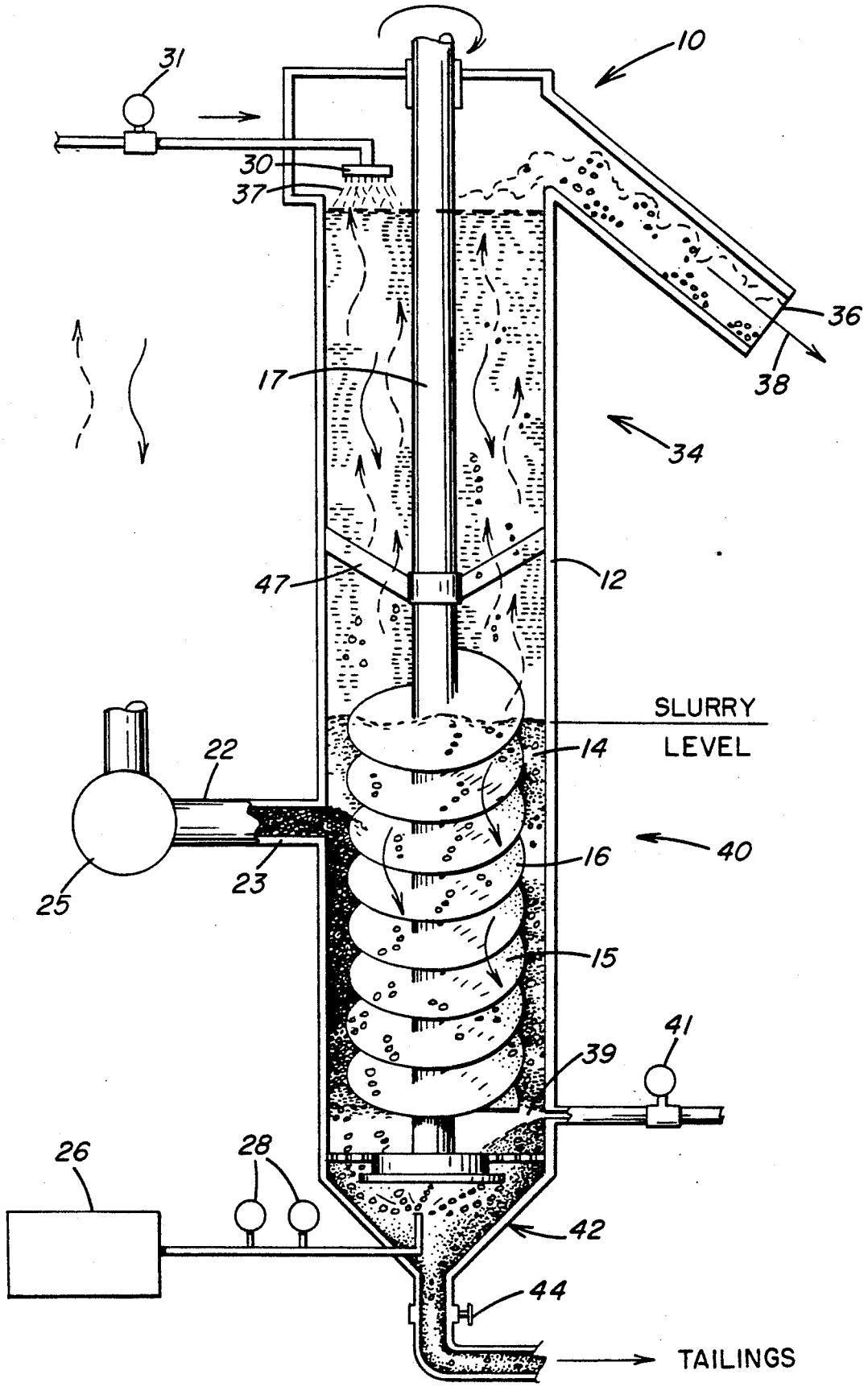
FIG. 2 is a view similar to FIG. 1, illustrating another embodiment of a mineral beneficiation vessel in accordance with the present invention.
Figure 4:
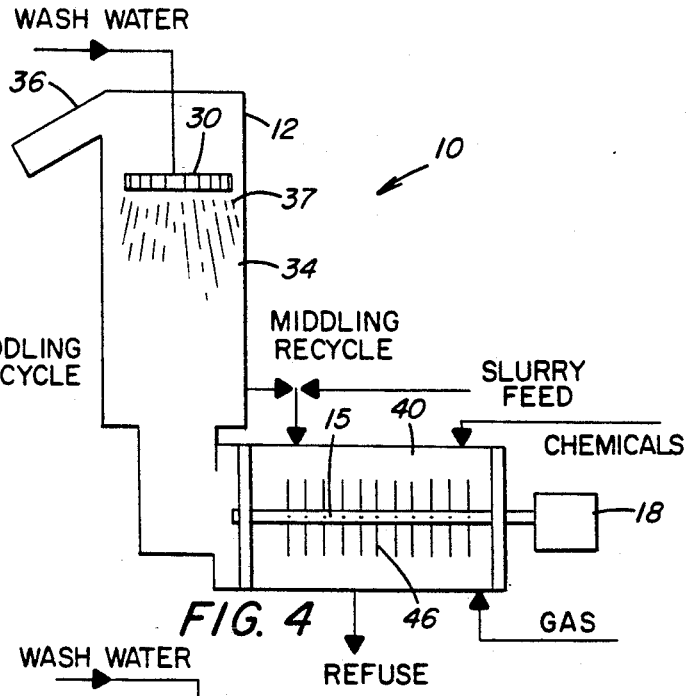
Figure 5:
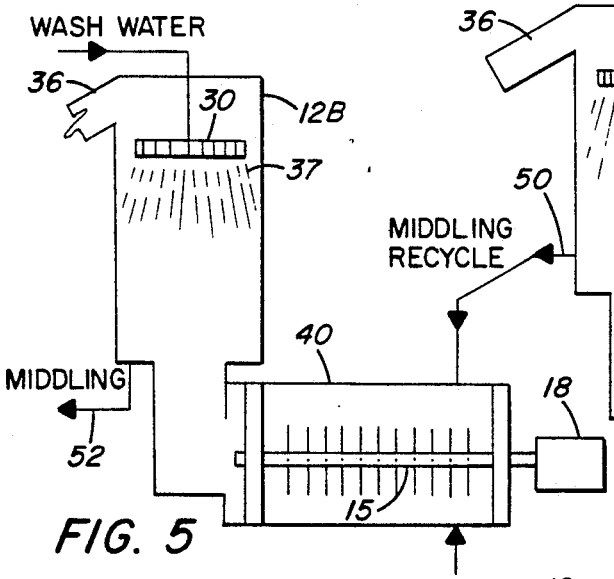
Figure 6:
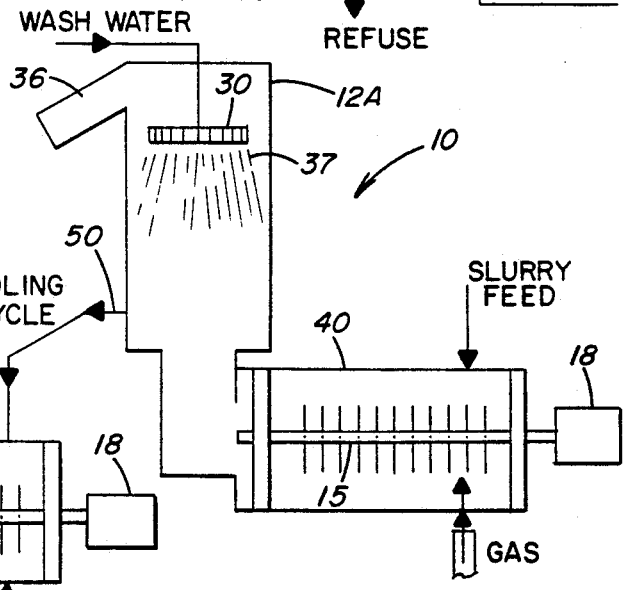
Figure 6:
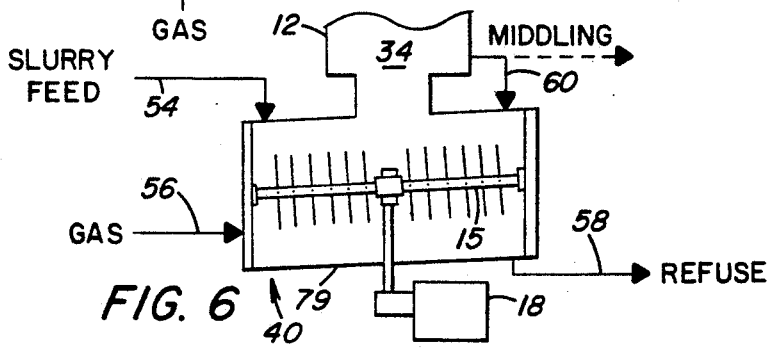

Referring to the drawings and particularly FIGS. 1 and 2, there is illustrated a size reduction and separation mill generally designated by the numeral 10 that includes a vessel 12 in the shape of an elongated tubular column preferably positioned upright, but which may be reclined at an angle or having portions positioned horizontally as shown in FIGS. 4–6, filled with grinding balls 14. The balls 14 are agitated in one mode by an agitator or rotor 15 having double helical spirals or paddles 16. The agitator 15 is rotated by a power source, such as a motor 18, connected to the end of the rotor 15 extending from the bottom of the vessel 12.

The mineral material, such as coal, to be ground is introduced as a slurry 23 near the middle or intermediate portion 20 of the vessel 12 by means of a raw feed pipe 22 and a slurry pump 25. The slurry 23 is formed by combining the raw mineral particles and water in a mixture slurry tank 24. The slurry 23 may be continuously recycled by means of a recycle pipe 27.

Air or gas is introduced into the mill 10 near a lower portion or bottom of the vessel 12 and is gauged by means of an air or gas flow meter 28. Froth flotation or other separation inducing fluids and chemicals are introduced into the mill 10 with or separately from the slurry 23. Wash water 37 is added near the top of the mill 10 by means of a water inlet and nozzle 30. The water flow is controlled and monitored by means of a flowmeter 31. The level of the slurry in the column is monitored by suitable means.

The weight of the balls and the movement of the balls in the vessel 12 cause size reduction of the material by attrition and shear, as well as by compression and impact. The reduction process may be varied by changing a number of factor which permit changes to be made in the rate of size reduction of the material into a valuable constituent, such as organic material, and an undersized constituent, such as gangue. The proportion of valuable constituent to undesired constituent is also variable. The variable factors include adjustments to the height of the grinding medium in the vessel 12 and the charge size of particles comprising the grinding medium.

Figure 7:
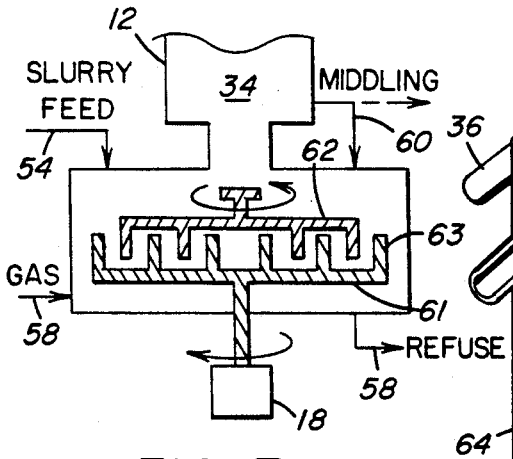

The grinding medium in the form of the balls 14 is under constant stress by the action of the vertical pressure load generated by the ball charge in the vessel 12 and the radial pressure exerted by the ball charge against the walls of the vessel 12. Fracture of the mineral material can also be accomplished by an agitating device as shown in FIG. 7 without use of a grinding medium in the form of balls. In addition the present invention includes fracture of the material by generating ultrasonic energy using conventional methods and apparatus in the vessel 12. The slurry feed is exposed to the ultrasonic energy. As a result the desired constituent is liberated from the undesired constituent. In all operations of fracturing the mineral material to be beneficiated a multiplicity of loading and unloading cycles of multidirectional forces, both vertical and radial are applied to the mineral material.

The particles of the mineral material in the slurry feed are fractured as shown in FIGS. 1 and 2 by grinding balls 14 to liberate from the particles the valuable constituent and the undesired constituent. Fracture of the particles occurs when the forces acting on the particles exceeds the tensile strength of the particles of mineral material. With this arrangement the forces generated at the bottom of the ball charge are the greatest. Preferably forces are generated only to the magnitude required to liberate the locked particles from the unlocked particles.

A higher proportion of unliberated (locked) particles exist at the bottom of the vessel than at the top of the ball charge. The liberated particles when unlocked rise to the top of the ball charge where the forces are less than the forces required to fracture the particles. At this point scrubbing of the liberated particles takes place to remove slimes and other detrimental materials from the surface of the particles.

The feed size of the slurry into the vessel 12 must be optimized with both the liberation and separation characteristics of the mineral material to be beneficiated. A finer feed size increases the capacity of the mill by increasing the rate of liberation of the valuable constituent from the undesirable constituent. Also an increase in the height of the ball charge will increase the rate at which the valuable constituent and gangue are liberated to further increase the production capacity of the mill 10.

The ball charge may be comprised in one method of operation a selected distribution of ball sizes where the particle size of the slurry feed is substantially uniform. The grinding medium is added to the vessel 12 in two forms. First, the coarest ball size is used at regular intervals and in predetermined amounts. Preferably the ball charge size ranges from a maximum size to a minimum size. The size distribution is also effected by the wear characteristics of the balls.

In a second mode of operation balls of two or more sizes are added in predetermined amounts at predetermined intervals based on wear characteristics of the balls. The ball charge size distribution is controlled to provide the maximum effectiveness in the liberation of the valuable constituent from the mineral material and separation from the gangue. Other factors which influence the reduction process include the diameter of the vessel 12, the pitch of the helical spirals 16 of the agitator 15, the clearance between the spirals 16 and the walls of the vessel 12, the rate of rotation of the agitator 15, the packed bed porosity of the ball charge, the nature of the balls, and the rate of erosion of the balls.

As illustrated in FIG. 1 the vessel 12 is partially filled with the balls 14 to form a bed of balls interspersed with a large number of small flow passages 32 extending in a circuitous pattern between the upper and lower portions of the vessel 12. The balls 14 can be discharged from the vessel 12 through valved outlet 31. In one mode of operation as further illustrated in FIG. 1 wash water is introduced into the upper portion of the vessel 12 and dispersed from the nozzle 30. The slurry 23 is introduced into a classifying zone 33 located in the intermediate portion 20 of the vessel 12 flows downwardly through the passages 32.

Pressurized gas is introduced into the lower portion or refuse zone 42 of the vessel 12 through the gas inlet 26 and is forced upwardly through a grate 43 that supports the bed of balls 14 in the vessel 12. The upward flow of pressurized gas is counter to the downward flow of water 30 and slurry 23 through the flow passages 32. When the agitator 15 in the size reduction or grinding zone 40 is rotating, the balls 14 are moving in the vessel 12 so that the configuration of the passages 32 is changing continuously.

As the gas passes through the flow passages 32 formed by the charge of balls 14, the gas is broken up into fine bubbles of relatively uniform size. These bubbles rise upwardly in the vessel 12 and intimately contact the mineral particles of the slurry 23 in the flow passages 32 to produce a froth. The froth consists primarily of hydrophobic particles along with a minor amount of gangue/refuse material entrained in the froth. Along with the completely liberated mineral particles, locked particles consisting of varying proportions of the valuable constituent and the gangue or undesirable constituent become attached to the fine bubbles and rise with the bubbles.

The air bubbles carry the clean concentrate product upwardly into a separation compartment or zone 34 in the upper portion of the vessel 12. From the separation compartment 34 the product is discharged through a concentrate outlet 36 in the direction indicated by the arrow 38. Wash water from the nozzle 30 descending through the passages 32 in the bed of balls 14 passes the mineral particles laden froth and induces the entrained mineral particles and the less hydrophobic particles to separate from the clean product 38 discharged from outlet 36 and to be carried downwardly in the water phase into the grinding zone 40.

This slightly hydrophobic, nonliberated material is further ground in the grinding zone 40 with the feed material so that the valuable material is more completely liberated. The tailings (gangue and refuse) fraction containing the non-floatable particles collect in the refuse zone 42 at the bottom of the vessel 12 and are discharged through an outlet conduit 45 controlled by a valve 44. A suitable fluid slurry level is maintained in the vessel 12. This is accomplished by operation of the variable flow slurry pump 25.

Thus the degree of grinding and removal of material from the mill 10 is dependent on the quality of the refuse and concentrate. The valuable mineral particles are removed from the size reduction zone 40 as soon as they are generated. The size reduction operation is also performed primarily on slightly "offspec" hydrophobic nonliberated material with the feed slurry 23. In this manner the valuable constituent is more completely liberated from the raw material. The tailings containing gangue and refuse contain the non-flotable particles which collect in the refuse zone 42 or tailing chamber 42 at the bottom of the vessel 12. The tailings are discharged through the valued conduit 45 controlled by valve 44. The result is that the material is not ground to a size finer than is necessary to achieve the concentrate grade and recovery required. In this manner the grinding efficiency and energy required for the size reduction is kept to a minimum.

In the mill 10, the rising air bubbles carry the floatable particles upward, and the water phase carries the non-floatable particles downwardly. The net effect is that the most floatable particles reach the concentrate discharge outlet 36 first and the most non-floatable move downward toward the tailings discharge outlet conduit 45 at the fastest rate. Feed material is continuously fed into the mill feed pipe 22. The incoming feed particles will continually redistribute and have a tendency to push each other from the feed point toward either of the two outlets 36 and 45.

Stratification of the material occurs at a steady-state operating condition and is based on floatability and grade of the material. The non-floatable and slow-floating material is reduced to a finer particle size in the lower size reduction section 40 of the mill 10 and is immediately separated and classified on the basis of grade. The grade gradient is controlled with an on-line analyzer by changing (1) any of the flow parameters which change the mass balance and water balance, and (2) the size reduction parameters which change the rate of size reduction of the material to liberation size and thus change the proportion of the floatable and non-floatable material in the system available for separation.

One of the major advantages of the mill 10 of the present invention is the ability to perform a plurality of unit operations in one device such as: (1) size-reduction, (2) classification, (3) conditioning, (4) scrubbing, (5) froth flotation, (6) regrinding or size reduction of middlings, and (7) reflotation or beneficiation of middlings. These process steps are diagrammatically illustrated in the following example.

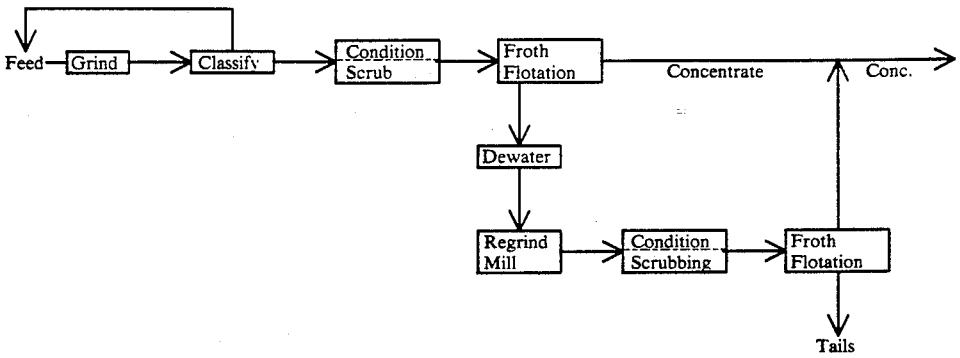

Use of the present invention will result in significant savings in capital and operating costs. The above example shows a typical froth flotation regrind circuit. Product from a rod mill or any other size reduction device is ground in a tumbling ball mill with a classifier. The product is scrubbed in a scrubber and then conditioned with chemicals in a conditioner. The conditioned slurry is then subjected to froth flotation. The high grade concentrate is removed and the low grade middling slurry is dewatered and reground to liberation size. This reground material is subjected to further conditioning. In the present invention all of these operations are conducted in one mill or a single vessel resulting in (1) lower capital costs, (2) reduced operating costs, (3) reduced maintenance costs, (4) reduced water requirements, (5) reduced space requirements, and (6) reduced energy requirements. Thus the floatable particles can be more effectively separated from the non-floatable particles with a single stage flotation.

In the present invention, the size reduction of the particle results in the production of a new surface which instantaneously comes in contact with the added chemical and/or the fresh air/gas bubble and rises to the top. This is in sharp contrast to conventional systems in which there is a relatively large time elapse between the production of the new surface, the addition of any of the chemical and the attachment of the surface to the bubble, and, beneficiation separation of the material.

The agitation of the media results in the break up and formation of air/gas bubbles to small relatively uniform sizes. This tends to eliminate the need for a special device in the bottom of the column or vessel for generating the fine air bubble.

With the embodiment of the size reduction and separation mill 10 shown in FIG. 2, where like numerals shown in FIG. 2 correspond to like parts illustrated in FIG. 1 and described hereinabove, the vessel 12 includes the size reduction compartment or grinding zone 40 and the separation compartment or zone 34 which in the embodiment shown in FIG. 2 also functions as a froth flotation section. The vessel 12 receives a slurry feed 23 from the raw feed pipe 22 and slurry pump 25 and water 39 from an inlet controlled by valve 41 into the grinding zone 40. The slurry feed and water are mixed with the ball charge contained in the grinding zone 40. The mixture of slurry feed, water and grinding balls 14 are agitated or moved by rotation of the agitator 15 which includes a rotatably driven shaft 17 that is rotatably supported by braces 47 in vessel 12 and extends upwardly through the top of the vessel 12 where it is also rotatably supported.

The helical spirals 16 of the agitator 15 are positioned in the grinding zone 40; thus, there is little movement of the ball charge in the separation zone or froth flotation section 34. Consequently, the movement of the ball charge in the grinding zone 40 is greater than the movement of the ball charge in the separation zone 34. This creates in the upper portion of the vessel 12 a quiescent froth flotation region where quiescent flotation occurs.

A gas under pressure is directed from a source 26 through valves 28 into the refuse zone 42 of the vessel 12. The gas injected into the slurry bed generates bubbles flow upwardly and encounter a continuously varying tortous path and downwardly flowing water. In this manner the hydrophobic or only slightly hydrophilic particles are removed from the desired constituent to be extracted from the outlet 36 of the vessel 12. The gangue and other refuse is removed from the refuse zone 42 through the valved outlet 44.

With the embodiments of the mill shown in FIGS. 1 and 2, if the ball charge weight and column height of the ball charge and size distribution remain constant an increase in the feed rate of the slurry 23 into the vessel 12 will reduce the rate of production of the liberated particles and accordingly, the rate at which the valuable constituent and undesirable constituent are removed from the vessel 12. In this instance the reduction capacity of the mill 12 is decreased; accordingly, the feed size is optimized according to both the liberation and separation characteristics of the material. This requires controlling the rate at which the slurry feed 23 is pumped into the vessel 12. A finer slurry feed size increases the capacity of the mill by virtue of the fact that the rate of liberation of valuable constituent from the material is increased where the undesired constituent is efficiently removed. In the event that increased efficiency of separation of valuable constituent from undesired constituent is desired attention must be given to the rate at which the mineral materials is fed into the vessel and under certain circumstances where there is a need to increase the separation efficiency, the feed rate into the mill is reduced.

The grinding medium in the form of the ball charge in the vessel 12 exerts vertical pressure as well as radial pressure against the sides of the vessel 12. The height of the medium and its weight at a point in the vessel 12 controls the pressures that are generated in the various directions. If the pressures generated are greater than those required to fracture the mineral material, the size reduction takes place. If the pressures are less than the forces required to fracture the mineral material, then only scrubbing of the surface of the particles takes place.

As the slurry feed 23 flows downwardly into the ball charge of the vessel 12 the particles of mineral material in the slurry feed are subjected to progressively greater pressures and are fractured. The movement of the finer and more hydrophobic particles upwardly in the mill 10 brings them into contact with progressively reduced pressures. At this point scrubbing takes place resulting in dispersions of the liberated particles and cleaning of the particle surfaces of slimes and other detrimental materials. Accordingly, an increase in the height of the ball charge increases the rate at which the valuable constituent and gangue are liberated from the mineral materials fed into the vessel 12 and in turn increases the output capacity of the mill 10.

Another factor to be considered in the operating efficiency of the mill 10 is the relationship between the particle size of the grinding medium and the particle of the slurry feed. The slurry feed size is controlled according to the size of the particles comprising the grinding medium. For a constant particle size distribution in the slurry feed, a finer ball charge generates a finer product size where the mineral material is ground to an extremely fine size. Another factor to be considered is inherent separation taking place without exposure to a grinding medium as a result of the slurry feed size being reduced prior to entering the vessel 12. Upon entrance separation begins without a particle size reduction required to take place.

In one embodiment the grinding medium includes the addition of the coarsest ball size used at regular intervals and in predetermined amounts. Preferably the ball charge would range from a maximum particle size to a minimum particle size. The size distribution is dependent on the wear characteristics of the balls. The ball medium in another embodiment comprises two or more sizes added in predetermined amounts at predetermined intervals where the ball charge size distribution is a factor of the wear characteristics of the balls. Overall, the ball charge size distribution is controlled so as to achieve the maximum effectiveness to attain a preferred particle size of liberated product from the slurry feed.

The agitator 15 illustrated in the mills 10 shown in FIGS. 1 and 2 is rotated at a preselected rate. Accordingly, the greater rate of rotation, the greater the rate of grinding or size reduction of the mineral material to the desired particle size of the liberated or desired constituent. The greater the rate of rotation, the greater the grinding capacity and output of the mill 10. Preferably the agitator 15 is rotated at a rate which produces a grinding capacity that preferably liberates the valuable constituent from the mineral material by grinding to what is known as the liberation size to form the unlocked particles of valuable constituent in mixture with the gangue which is continuously being separated and removed from the valuable constituent. The grade of the valuable constituent and gangue also influence the amount of material present in the size reduction zone 40 of the mill 10 and also the slurry feed 23 into the mill 10.

Another factor to be considered in the operating efficiency of the mill 10 shown in FIGS. 1 and 2 is the relationship between the height of the classifying zone 33 and separation zone 34, the grade and recovery of the valuable product, and the amount of the nonfloating material entering in the size reduction zone 40. The rising column of gas bubbles and froth rising out of the grinding zone 40 meets the downwardly flowing slurry feed 23. This interaction allows the hydrophobic particles to be attached to the bubbles and froth and be carried into the separation zone 34. A portion of the feed material may never enter the size reduction zone, thus reducing the amount of material that needs to be reduced to a finer size. An increase in the height of the classifying zone would enhance the efficiency with which the liberated particles in the feed can be separated without further size reduction which would impact on the size distribution of the valuable product 38 that is collected.

As the bubbles and froth carry the hydrophobic particles through the classifying zone into separation zone, an opportunity is afforded for the less hydrophobic particles to be detached and settle downwardly back into the grinding zone. The particles that remain attached to the bubbles are collected at the top of the column in vessel 12. An increase in the height of the separation zone insures that only the most hydrophobic particles are recovered and thus enhance the grade or quality of the valuable constituent 38 collected.

The addition of the downwardly flowing wash water 37 through a sprayer 30 near the top of the separation zone detaches the more hydrophilic particles from the froth moving upwardly toward the outlet 36 and carries them downwardly towards and into the grinding zone 40. By increasing the amount of wash water 37 and positioning of the sprayer in the separation zone, the more hydrophobic particles will remain attached to the bubbles and thus enhance the grade and quality of the valuable constituent 38 collected. This step increases the amount of material that is carried back into the grinding zone.

Varying the heights of the classifying zone and separation zone, the rate of wash water, and the position of, the wash water influences the quality of the material 38 that is collected. This will also affect the quality of the gange, the rate at which the gange and valuable constituent are collected, the capacity of the mill, the amount of material present in the size reduction zone 40 of the mill, and the nature of the slurry feed 23 into the mill 10.

Now referring to FIGS. 3–8 there is illustrated further embodiments of the mill 10 in which like numerals shown in FIGS. 3–8 designate like parts as shown in FIGS. 1 and 2 above described. The agitator 15 as shown in FIGS. 1 and 2 includes helical spirals 16 but it should also be understood that the agitator may include rotating pins or spokes 46 as shown in (FIGS. 3–8. The pins are of varying length, cross section and shape and extend from the rotating shaft of the agitator 15. The pins generate force sufficient to fracture the mineral material without the need for the addition of grinding balls into the vessel.

As shown in FIG. 1, as well as in FIGS. 3–8, the agitator 15 is rotated by a motor 18 from the bottom or from a drive connection at any point along the length of the agitator 15, as for example, intermediate the agitator 15 as shown in FIG. 6. In FIG. 2 the agitator is driven by a suitable power means from the top of the vessel 12. As shown in FIG. 7 size reduction is performed by means of two interacting discs 61 and 62, one stationary and the other rotating, or both rotating in opposite directions by operation of motor 18. The discs have pins 63 of varying lengths, cross section and shape and extend from the rotating discs.

Figure 3:
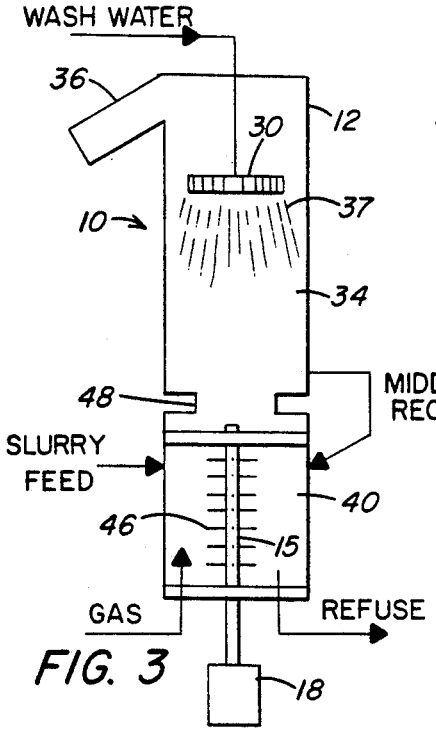
FIGS. 3–8 are schematic illustrations of further embodiments of a beneficiation vessel.

In FIGS. 1–3 the entire vessel 12 is vertically positioned but it may be positioned at any angle or have portions which are angled respect to each other such as shown in FIGS. 4 and 5 where the size reduction zone 40 is positioned horizontally relative to a vertically extending separation zone 34. In the alternative the entire vessel 12 may be positioned horizontally with the agitator 15 positioned within the vessel inclined from the horizontal as shown in FIG. 6.

While the respective compartments or zones of the mill 12 are aligned in one embodiment as shown in FIGS. 1-3, the compartments may be angularly oriented from one another to form discreetly separate zones. The mills 10 shown in FIGS. 4 and 5 have discreet separations between the reduction zone 40 and the separation zone 34. In FIG. 3 there is illustrated an arrangement where the mill 10 includes vertically aligned reduction and separation zones but a reduced area 48 in the diameter of the vessel 12 discreetly separates the two zones 34 and 40.

Figure 8:
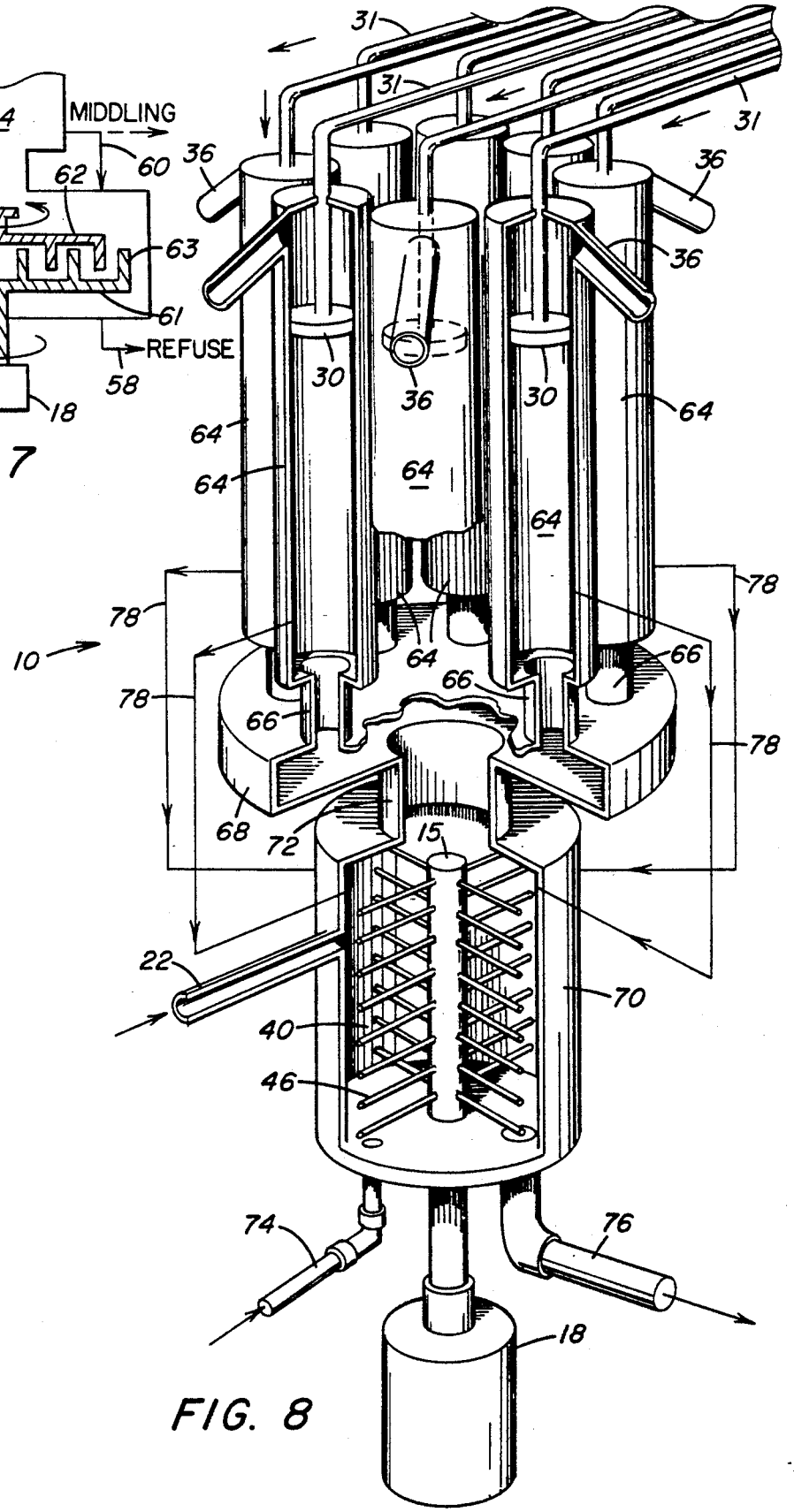

FIG. 8 illustrates a further embodiment of the present invention of the mill 10 that includes a plurality of circumferentially spaced separation zone vessels 64, each similar in construction to separation zone 34 discussed above and illustrated in FIGS. 1 and 2. Like numerals of FIGS. 1 and 2 designate like parts shown in FIG. 8 where each separation zone vessel 64 includes a reduced lower end portion 66 that communicates with a distributor 68.

The size reduction zone 40 is formed by a vessel 70 having a reduced upper end portion 72 connected axially with the distributor 68. A driven agitator 15, as shown in FIG. 1, is positioned in the reduction zone vessel 70 which is also provided with a raw feed pipe 22 for the slurry input. A pipe 74 introduces a gas under pressure into the reduction zone 40. A pipe 76 discharges the tailings from the vessel 70. In addition each separation zone vessel 64 includes conduits 78 (schematically shown in FIG. 8) for recycling middlings from the vessel 64 back into vessel 70. Thus with the embodiment of the vessel 70 shown in FIG. 8, the output of desired constituent from the plurality of outlets 36 from the multiplicity of vessels 64 is substantially increased.

Now referring to the embodiment shown in FIG. 3, the wash water is introduced into the upper end portion of the vessel 12 through the nozzle 30 and the slurry feed is introduced through conduit 22 into the size reduction or grinding zone 40. In addition, gas is introduced from a source through valves 28 (shown in FIG. 2) into the lower end portion of the vessel 12 and the size reduction zone 40. The desired constituent is liberated from the mineral material and passes from the size reduction zone 40 through a plate (not shown in FIG. 3) containing holes or a wire mesh located at a reduced diameter portion 48 of the vessel that separates the zones 34 and 40.

The presence of the plate at the reduced diameter portion 48 serves to isolate the separation zone 34 from the size reduction zone 40. This confines the agitation of the slurry feed to the size reduction zone 40 and the agitation is not transmitted upwardly into the separation zone 34. Consequently a relatively quiescent condition of the separation zone 34 is provided for efficient separation of the concentrate which is discharged from the outlet 36 from the middling or gange. The middling which passes from the size reduction zone 40 into the lower end portion of the separation zone 34 is recycled from the separation zone segment of the vessel 12 back into the size reduction segment of the vessel for further grinding. The refuse is discharged from the lower end portion of the vessel 12 out of the size reduction zone 40.

Now referring to FIG. 4, there is illustrated an embodiment of the mill 10 that corresponds to the embodiment shown in FIG. 3 with the modification of orienting the portion of the vessel 12 that comprises the size reduction zone 40 horizontally relative to the vertically extending portion which comprises the separation zone 34. With the embodiment shown in FIG. 4, not only is middling from the separation zone 34 recycled back into the size reduction zone 40, it is also admixed with the slurry feed which is introduced into the size reduction zone 40.

The mill 10 shown in FIG. 5 includes a pair of vessels 12 corresponding to the single vessel 12 shown in FIG. 4. With the arrangement shown in FIG. 5 a first vessel 12A receives an input of slurry feed and gas into the size reduction zone 40 in the manner above described where the valuable constituent is liberated from the gangue and discharged from the outlet 36. The undesirable constituent, having been separated from the concentrate, is discharged from the separation zone 34 through outlet 50 and is introduced as input into the size reduction zone 40 of the adjacently positioned vessel 12B.

As with the vessel 12A, gas is introduced into the separation zone 40 of 12B. The mixture is agitated to produce further size reduction and separation of valuable constituent from the gangue. The mixture of valuable constituent and gangue advances from the size reduction zone 40 into the lower end portion of the separation zone 34 where the valuable constituent is separated from the gangue or middling. The valuable constituent is discharged from the outlet 36 and the middling or undesirable constituent is discharged from the separation zone 34 through the outlet 52.

And now referring to FIG. 6, there is shown an embodiment of the mill 10 in which the vessel 12 includes as the size reduction zone 40 a compartment 79 positioned at an angle inclined from the horizontal where the separation zone 34 extends upwardly from the size reduction compartment 79. With this arrangement, the slurry feed and gas are introduced through inlets 54 and 56 at one end of the size reduction compartment 79. The agitator 15 is driven intermediate its end portions in the compartment 79. At the opposite end of compartment 79 refuse is discharged through outlet 58.

The liberated valuable constituent rises upwardly in the manner as above described from the size reduction compartment 40 into the separation zone 34 and is discharged from an outlet (not shown in FIG. 6) from the upper end portion of the separation zone 34. The hydrophilic and only slightly hydrophobic particles are separated from the concentrate in the zone 34 and are removed from the vessel through outlet 60 and may be recycled, as illustrated, back into the size reduction compartment 79 or completely removed from the vessel 12.

Similarly with the arrangement shown in FIG. 7 the rotating discs 61 and 62 reduce the particle size of the mineral material in the size reduction zone 40. Slurry feed and gas are introduced through inlets 54 and 56 at one end of zone 40. Refuse is discharged from zone 40 through outlet 58.

It should also be understood that the present method and apparatus is particularly designed for providing an improved means for beneficiation of carbonaceous and noncarbonaceous mineral material, as well as in other embodiments such as:

(1) true heavy media separation when the heavy liquid is used instead of water so as to make separation based on differences in the density of the constituents;

(2) selective agglomeration in which oil, other hydrocarbon, or an agglomerant is introduced into the mill to form the agglomerates which are separated from the non-agglomerated material;

(3) selective flocculation in which the flocculant is added with the fluid so that certain components of the material can be selectively flocculated and separated as soon as these components are liberated;

(4) leaching where the leaching fluid is used instead of water so as to selectively dissolve components in the material being treated; and (5) homogenizer for comminuting and mixing of substances, especially of various solids, or solids, liquids and gasses, for producing a homogeneous mixture of the various substances which in conformity with the requirements are uniformly distributed and comminuted.

More specifically, with the heavy liquid separation method a mill as described above and illustrated in FIGS. 1-7 is utilized where the material to be ground is introduced with chemicals in the nature of heavy liquid having a predetermined density at approximately middle of the vessel 12 in slurry form. A suitable pulp level is maintained in the vessel and additional heavy liquid is introduced into the vessel near the bottom thereof. The movement of the grinding balls 14 or other agitatiang means in the manner above described acts upon the slurry to reduce the size of the particles in the slurry. The size reduction takes place in the size reduction zone or compartment 40 of the vessel 12. The size reduction is generated as a result of attrition, shear, and to a lesser degree, by compression and impact.

The heavy liquid flows downwardly through the flow passages that extend in a circuitrous pattern between the upper and lower portions of the vessel 12. The lower density desired constituent rises upward into the upper portion or separation zone of the vessel 12 and is discharged through the concentrate outlet 36. The heavy liquid descending through the small flow passages interspersed throughout the bed of ball charge induces the entrained mineral material and the higher density particle to separate from the unlocked desired constituent. The heavy liquid with this material is carried downwardly, and the liquid phase into the grinding zone 40 of the vessel 12.

In this manner, as above described, the higher specific gravity ("off-spec"), non-liberated materials further reduced in size so that the valuable constituent is more completely liberated. The refuse, such as high ash particles, is collected in the refuse zone 42 and is discharged therefrom through the valued outlet 44.

In the heavy liquid method of separation and according to the present invention, the size reduction of the mineral material, such as coal, results in the production of particles which are organic-rich and mineral matter-rich. These particles instanteously come in contact with the heavy liquid. The particles either (1) rise toward the top and out of the size reduction zone or, (2) sink to the bottom and finally out of the size reduction zone, or (3) remain substantially in the size reduction zone for further grinding and liberation. As a result there is less tendency of the refuse to attach, or agglomerate, or be entrained in the clean coal Moreover, since the particles that need to be reduced to liberate the coal remain in the size reduction zone, production of fines is kept to a minimum. This is in contrast to conventional systems in which there is a relatively large time lapse between the production of the new surface and the separation of the coal from the refuse. As a result, a single stage device is provided with is equivalent to a multiple stages in a conventional circuit.

In the heavy liquid method of separation, the heavy liquid carries the lower density particles upward, while the particles move downward. The net effect is that the most floatable particles reach the concentrate discharge point and the most non-floatable move downwardly toward the tailings discharge point at the fastest rate. Material is fed continuously into the mill near the middle of the vessel. The incoming feed particles will continually redistribute and have a tendency to push each other away from the feed point toward either of the two outlets. A stratification of the material occurs based on density, distribution and grade. The non-floatable and slow-floating near gravity material is ground to the finer size in the size reduction compartment of the mill and is immediately separated on the basis of grade. This is also in sharp contrast to conventionally grinding mills where the separation is based primarily on particle size.

In the beneficiation process that utilizes separation by selected agglomeration the ball mill 10 as above described is also utilized where the ball charge forms a large number of small flow passages that extend in a circuitous pattern between the upper and lower portions of the vessel 12. With this method a small amount of water is introduced into the lower portion of the vessel with the selected agglomerate, such as naptha, heptane and the like, and is forced upwardly through the flow passages. As the agglomerate passes through the flow passages in the grinding balls, it is broken up and dispersed evenly in the mill. The selected agglomerate intimately contacts the desired constituent that has been liberated from the mineral matter in the flow passages to produce agglomerates consisting primarily of the desired constituent. The liberated constituent and agglomerates move upwardly into the upper portion or the separation zone 34 of the vessel 12 and are discharged through the concentrate outlet 36. The hydrophilic particles separate from the desired constituent and are carried downwardly in the water phase into the size reduction zone 40 of the vessel 12.

The slightly "off-spec", non-liberated material is further reduced in size so that the desired constituent is more completely liberated from the mineral material. The refuse settles downwardly through the size reduction zone 40 to the refuse zone 42 where it is discharged through a valve outlet.

Size reduction of the mineral material as above described, generates new surfaces consisting of liberated desired constituents, mineral particles, and locked particles. The valuable constituent particles instanteously come in contact with the added agglomerate and move upwardly out of the size reduction zone 40. The hydrophilic mineral particles settle out of the size reduction 40 and into the refuse zone 42 for removal from the mill 10. Agglomerates of locked particles remain in the size reduction zone 40 where the grinding action of the balls 14 liberate the mineral matter and separate it from the agglomerate. In this manner the possibility of refuse slimes remaining attached or being entrapped by the large surfaces is substantially reduced.

Further, in the selective flocculation method of beneficiation the mineral material is also introduced near the top or into the size reduction zone 40 of the mill 10 and moves downwardly toward the bottom of the vessel 12. The slurry feed interacts with the selected flocculant which is introduced near the bottom of the size reduction zone 40 and moves upwardly. In the size reduction 40 the selective flocculant is dispersed evenly throughout and comes into intimate contact with the liberated material to be flocculated.

The flocculated material is removed from the size reduction zone 34 by the upward flow of the fluid into the quiescent separation zone 34 where it is removed as above described from the vessel 12. The material which is not flocculated settles to the bottom of the vessel 12, for example, in the refuse zone 42 and is discharged in a controlled manner through the valved outlet 44.

Leaching operations can also be performed in the beneficiation process of the present invention. Accordingly, various operations of size reduction of the mineral material, leaching of a component, separation of the leachate, and removal of the spent material from which the valuable component has been removed are conducted in the single vessel ball mill 10 of the present invention. The mineral material slurry feed is introduced into the upper portion of the size reduction zone 40 and moves downwardly toward the bottom. The slurry feed interacts with the fluid introduced near the bottom of the vessel 12 and moves upwardly through the size reduction zone 34. The size reduction takes place in the manner above described and as a result of the agitation generated, the component is leached into the fluid and rises upwardly into the separation zone 34 where it is removed from the vessel 12. The spent material is collected in the refuse zone at the bottom of the vessel 12 and is discharged therefrom. By varying the operating parameters, such as feed rate, residence times, leaching fluid type and flow rate, the process can be selectively controlled.

According to the provision of the patent statutes, I have explained the principle, preferred construction and mode of operation of my invention and have illustrated and described what I now consider to represent its best embodiments. However, it should be understood that, within the scope of the appended claims, the invention may be practiced, otherwise than as specifically illustrated and described.

I claim:

1. Apparatus for producing a beneficiated mineral product comprising, an elongated vessel having an upper end portion with an opening and a lower end portion with an opening, a reducing zone provided in said vessel lower end portion, an inlet in said vessel positioned intermediate said upper and lower end portions for introducing into said vessel a downward flow of slurry of mineral product, means positioned in said vessel for agitating the mineral product to reduce the particle size of the mineral product into a desired constituent and an undesired constituent, said agitating means including a grinding medium dispersed throughout said reducing zone to form a plurality of flow passages extending in a circuitous pattern throughout said grinding medium, means for injecting said fluid under pressure in said reducing zone into contact with said grinding medium to form a plurality of bubbles passing upwardly through said circuitous flow passages, said desired constituent being less dense than said undesired constituent, said desired constituent being separated from said undesired constituent by upward flow of said desired constituent with said fluid and downward flow of said undesired constituent in said vessel, an outlet in said opening of said vessel upper end portion for discharging the upward flow of said desired constituent out of said vessel, and an outlet in said opening of said vessel lower end portion for discharging said undesired constituent from said vessel.

2. Apparatus as set forth in claim 1 which includes, means for directing a flow of wash water downwardly in said vessel through said mineral product and said grinding medium.

3. Apparatus as set forth in claim 1 which includes, means for removing the undesired constituent from said vessel and recycling said undesired constituent into contact with said agitating means to further reduce the particle size of said undesired constituent to release therefrom said desired constituent.

4. Apparatus as set forth in claim 1 which includes, means for adding chemicals to a alter the surface characteristics of said desired and undesired constituents as soon as said constituents are formed as a result of size reduction of said mineral product.

5. Apparatus as set forth in claim 1 which includes, said vessel upper end portion being maintained in a first position with said vessel lower end portion being maintained in a second position at an angle with respect to said upper end portion.

6. Apparatus as set forth in claim 1 which includes, said vessel upper end portion being vertically positioned and said vessel lower end portion being horizontally positioned with respect to said upper end portion.

7. A mill for the simultaneous size reduction of particulate mineral product and separation of the desired mineral constituent from the gangue comprising, an elongated vessel having an inlet for receiving a slurry feed of particulate mineral product, an upper outlet for discharging the desired mineral constituent, and a lower outlet for discharging the gangue, agitating means positioned in said vessel and extending upwardly from adjacent said lower outlet for fracturing said particulate mineral product into a desired mineral constituent and a gangue, said agitating means including a bed of grinding balls in said vessel, an inlet for introducing fluid under pressure into said mixture with said desired mineral constituent to form a froth, said fluid under pressure being injected upwardly in said bed of grinding balls and said slurry feed being injected downwardly in said bed of grinding balls to form a plurality of flow passages interspersed in a circuitous pattern throughout said bed of grinding balls to facilitate said separation of the desired mineral constituent from the slurry feed and forming a rising column of froth, said desired mineral constituent being entrained in said froth and rising upwardly in said vessel out of mixture with said gangue for discharge through said upper outlet, and said gangue being entrained in said slurry feed and descending downwardly in said vessel for separation for said desired mineral constituent and removal from said vessel through said lower outlet.

8. A mill as set forth in claim 7 which includes, a reducing compartment of said vessel for positioning said agitating means and receiving said slurry feed, a separating compartment positioned above said reducing compartment in said vessel, said desired mineral constituent being liberated from said particulate mineral product in said reducing compartment, and said desired mineral constituent being carried by said fluid under pressure from said reducing compartment to said separating compartment immediately upon liberation from said mineral product.

9. A mill as set forth in claim 7 which includes, a reducing compartment of said vessel for receiving said slurry feed, a separating compartment positioned above said reducing compartment in said vessel, said desired mineral constituent being liberated from said particulate mineral product in said reducing compartment, and said desired mineral constituent being carried by said fluid under pressure from said reducing compartment to said separating compartment immediately upon liberation from said mineral product.

10. A mill as set forth in claim 7 which includes, an inlet for introducing fluid into said mixture with said desired mineral constituent to form agglomerates and flocculants, said desired mineral constituent rising upwardly in said vessel for discharge through said upper outlet, and said gangue descending downward in said vessel for subsequent removal through said lower outlet.

11. A mill as set forth in claim 7 which includes, means for continuously injecting a feed of slurry into said vessel above said agitating means, means for adding a surfactant for flow downwardly through said slurry, and means for injecting said fluid under pressure upwardly in said vessel in a direction of flow counter to the downward flow of said slurry feed and surfactant.

12. A mill as set forth in claim 7 which includes, a grinding zone in said vessel for receiving and maintaining said agitating means including a grinding medium, a separation zone positioned above said grinding zone for receiving the desired mineral constituent liberated from said slurry feed in said grinding zone, and a refuse zone positioned below said grinding zone for receiving the gangue separated from said desired constituent in said grinding zone.

13. A mill as set forth in claim 12 which includes, said grinding zone, said separation zone, and said refuse zone being vertically aligned in said vessel.

14. A mill as set forth in claim 12 which includes, said grinding zone and said refuse zone being angularly displaced from said separation zone in said vessel.

* * * * *